US008752405B2

(12) United States Patent
Kim et al.

(10) Patent No.: US 8,752,405 B2
(45) Date of Patent: Jun. 17, 2014

(54) WASHING MACHINE AND CONTROL PANEL ASSEMBLY THEREOF

(75) Inventors: Jin Doo Kim, Osan-si (KR); Jeong Ki Seo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1213 days.

(21) Appl. No.: 12/071,797

(22) Filed: Feb. 26, 2008

(65) Prior Publication Data

US 2008/0289940 A1 Nov. 27, 2008

(30) Foreign Application Priority Data

May 25, 2007 (KR) ..... 10-2007-0050632

(51) Int. Cl.
*D06F 37/00* (2006.01)

(52) U.S. Cl.
USPC ..... 68/212

(58) Field of Classification Search
USPC ..... 68/3 R, 212
See application file for complete search history.

(56) References Cited

FOREIGN PATENT DOCUMENTS

| | | | |
|---|---|---|---|
| GB | 1444156 A | * | 7/1976 |
| GB | 2130438 A | * | 5/1984 |
| JP | 06182091 A | * | 7/1994 |
| KR | 10-2006-0103578 | | 10/2006 |
| WO | WO 2006001618 A1 | * | 1/2006 |

OTHER PUBLICATIONS

Machine Translation of Yeong, KR 2006103578 A, Oct. 2006.*
Machine Translation of Suzuki, JP 06-182091 A, Jul. 1994.*
Chinese Office Action issued Jan. 11, 2011 in corresponding Chinese Patent Application 200810085468.X.

* cited by examiner

*Primary Examiner* — David Cormier
(74) *Attorney, Agent, or Firm* — Staas & Halsey LLP

(57) ABSTRACT

Disclosed is a washing machine, a control panel assembly of which has an improved structure to minimize problems caused by a shaking of a rotary knob and the interference of the rotary knob with other surrounding parts. The control panel assembly of the washing machine includes a control panel; a knob guide installed on the control panel; and a rotary knob rotatably mounted on the knob guide and including a boss passing through the knob guide. The knob guide includes a boss insertion part restricting the boss to prevent the rotary knob from shaking. The boss insertion part includes an extension extended from the bottom surface of the knob guide and forming a boss insertion hole, into which the boss is inserted, therein.

5 Claims, 7 Drawing Sheets

PRIOR ART

WASHING MACHINE AND CONTROL PANEL ASSEMBLY THEREOF

CROSS-REFERENCE TO RELATED APPLICATIONS

This application claims the benefit of Korean Patent Application No. 2007-0050632, filed May 25, 2007, in the Korean Intellectual Property Office, the disclosure of which is incorporated herein by reference.

BACKGROUND

1. Field

The present invention relates to a washing machine, and more particularly, to a washing machine, a control panel assembly which has an improved structure to minimize problems caused by a shaking of a rotary knob and an interference of the rotary knob with other surrounding parts.

2. Description of the Related Art

Washing machines are apparatuses that wash clothes using electric power. In general, a washing machine includes a tub storing washing water, and a drum rotatably installed in the tub. When the drum is rotated or a pulsator installed in the drum is rotated under the condition that laundry and washing water containing a detergent are put into the drum, the laundry rubs against the drum and the washing water, thus being washed.

The washing machine further includes a control panel assembly installed on an upper end of a front surface of a main body forming the external appearance of the washing machine to control the operation of the washing machine. FIG. 1 is an exploded perspective view of a control panel assembly of a conventional washing machine.

The control panel assembly of the washing machine shown in FIG. 1 includes a substrate 3, on which various electric components, such as a rotary switch 1 and LEDs 2, are installed, and a control panel 4 covering the substrate 3 to protect the substrate 3 and provided with an opening 4*a* formed through one side thereof. A decoration window 5 is installed at the opening 4*a* of the control panel 4. The decoration window 5 transmits light irradiated from the LEDs 2, and is provided with a through hole 5*a* to pass a rotary knob 6 therethrough. An encoder bracket 7 covering the LEDs 2 to protect the LEDs 2 is installed on the substrate 3, and the rotary knob 6 is connected to a rotary shaft 1*a* of the rotary switch 1 installed on the substrate 3. When the control panel 4 and the substrate 3 are assembled, the rotary knob 6 is protruded forward from the control panel 4 through the through hole 5*a* of the decoration window 5.

In such a control panel assembly, when a user manipulates the rotary knob 6, the rotary knob 6 shakes and thus provides an unpleasant feeling to the user. That is, since the rotary switch 1 is fixed to the substrate 3 having a small thickness, the rotary knob 6, which is assembled with the rotary switch 1, is easily shaken together with the rotary switch 1. This problem can be solved by reducing the size of the through hole 5*a* to allow the decoration window 5 to prevent the shaking of the rotary knob 6. However, in this case, when the rotary knob 6 is manipulated, the rotary knob 6 interferes with the decoration window 5 and thus cannot be smoothly rotated, or the rotary knob 6 provides an unpleasant feeling to the user. Further, noise due to friction occurs.

SUMMARY

Therefore, one aspect of the embodiment is to provide a washing machine, which minimizes a shaking of a rotary knob, and a control panel assembly thereof.

Another aspect of the embodiment is to provide a washing machine, which minimizes problems caused by an interference of a rotary knob with other surrounding parts, and a control panel assembly thereof.

Additional aspects and/or advantages will be set forth in part in the description which follows and, in part, will be apparent from the description, or may be learned by practice of the invention.

The foregoing and/or other aspects are achieved by providing a washing machine having a control panel assembly to control an operation of the washing machine, the control panel assembly including a control panel; a knob guide installed on the control panel and including a boss insertion part; and a rotary knob rotatably mounted on the knob guide and including a boss passing through the knob guide, wherein the boss insertion part restricts the boss to prevent the rotary knob from shaking.

The boss insertion part may include an extension extended from a bottom surface of the knob guide and forming a boss insertion hole, into which the boss is inserted, therein.

An inner surface of the extension forming the boss insertion hole may be inclined such that a distance between the inner surface of the extension and the boss gradually increases from a point at which the extension abuts the boss.

A diameter of the boss insertion hole may be varied in an extended direction of the extension.

The rotary knob may include a connection part connected to the knob guide when the rotary knob is mounted on the knob guide; and the knob guide may include a restriction part restricting the connection part of the rotary knob.

The connection part may include at least one hook protruded towards the knob guide and connected to the knob guide when the rotary knob is mounted on the knob guide, and the restriction part may include at least one hook protruded towards the rotary knob and restricting the rotary knob when the rotary knob is mounted on the knob guide.

The connection part may include first hooks protruded towards the knob guide, and the restriction part may include second hooks protruded towards the rotary knob and engaged with the first hooks of the connection part.

The foregoing and/or other aspects are achieved by providing a control panel assembly of a washing machine including a rotary knob including a boss protruded therefrom; and a knob guide including a base panel to pass the boss through a central portion thereof, and an extension extending from the base panel to restrict the boss.

The extension may be inclined such that a distance between the extension and the boss gradually decreases in an extended direction of the extension to a point at which the extension abuts the boss.

The rotary knob may include first hooks protruded towards the knob guide, and the knob guide may include second hooks protruded towards the rotary knob and engaged with the first hooks when the boss of the rotary know is passed through the central portion of the base panel of the knob guide.

Drain holes to drain water flowing from an outside to the base panel may be formed through the base panel.

The foregoing and/or other aspects are achieved by providing a washing machine, including: a drum to receive laundry to be washed; and a control panel assembly, including: a rotary knob including a boss extending therefrom; and a knob guide receiving the boss and including an angled extension contacting the received boss to restrict the boss.

The angled extension may abut the boss at an abutting point and angle away from the boss from the abutting point to increase a diameter of a boss insertion hole formed between the angled extension and the boss.

The knob guide may include a restriction part and the rotary knob may include a connection part, the restriction part and the connection part being engaged to fix the rotary knob to the knob guide when the boss is received by the knob guide.

At least one of the knob guide and the rotary knob may include a connection part and an other of the knob guide and the rotary knob may include connection holes formed through the other of the knob guide and the rotary knob, the connection part being received into the connection holes to affix the rotary knob and the knob guide to one another.

The foregoing and/or other aspects are achieved by providing a washing machine, including: a drum to receive laundry to be washed; and a control panel assembly, including: a rotary knob including a connection part extending therefrom; and a knob guide including a restriction part extending therefrom, wherein the connection part and the restriction part are engaged to fix the rotary knob to the knob guide.

The rotary knob may include a boss extending therefrom and the knob guide receives the boss and includes an angled extension contacting the received boss to restrict the boss.

The angled extension may abut the boss at an abutting point and angle away from the boss from the abutting point to increase a diameter of a boss insertion hole formed between the angled extension and the boss.

BRIEF DESCRIPTION OF THE DRAWINGS

These and/or other aspects and advantages will become apparent and more readily appreciated from the following description of the embodiment, taken in conjunction with the accompanying drawings in which.

DETAILED DESCRIPTION OF THE EMBODIMENTS

Figure 1:
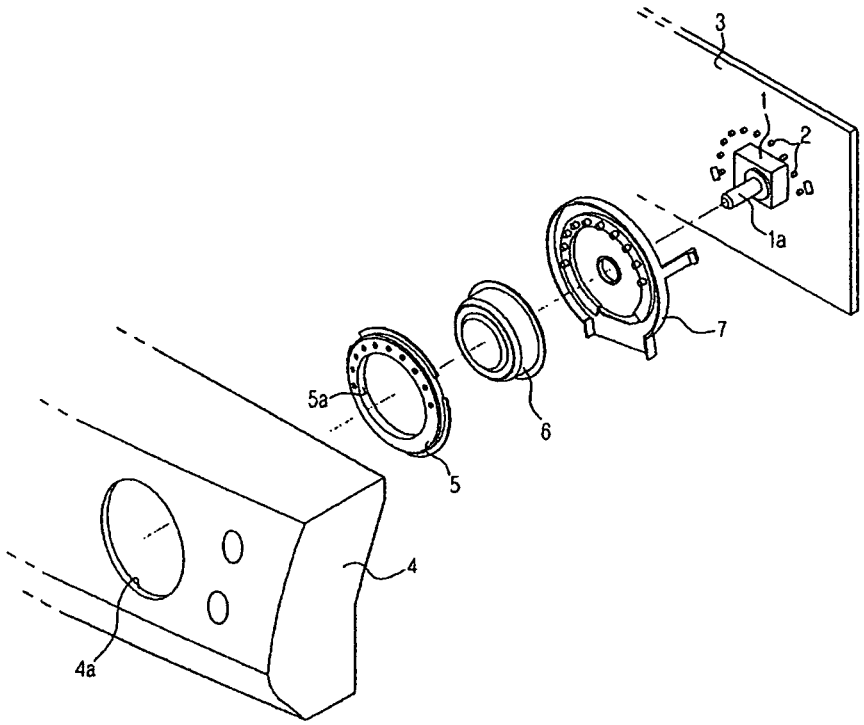
FIG. 1 is an exploded perspective view of a control panel assembly of a conventional washing machine.

Reference will now be made in detail to the embodiment, an example of which is illustrated in the accompanying drawings, wherein like reference numerals refer to like elements throughout. The embodiment is described below to explain the present invention by referring to the annexed drawings.

Figure 2:
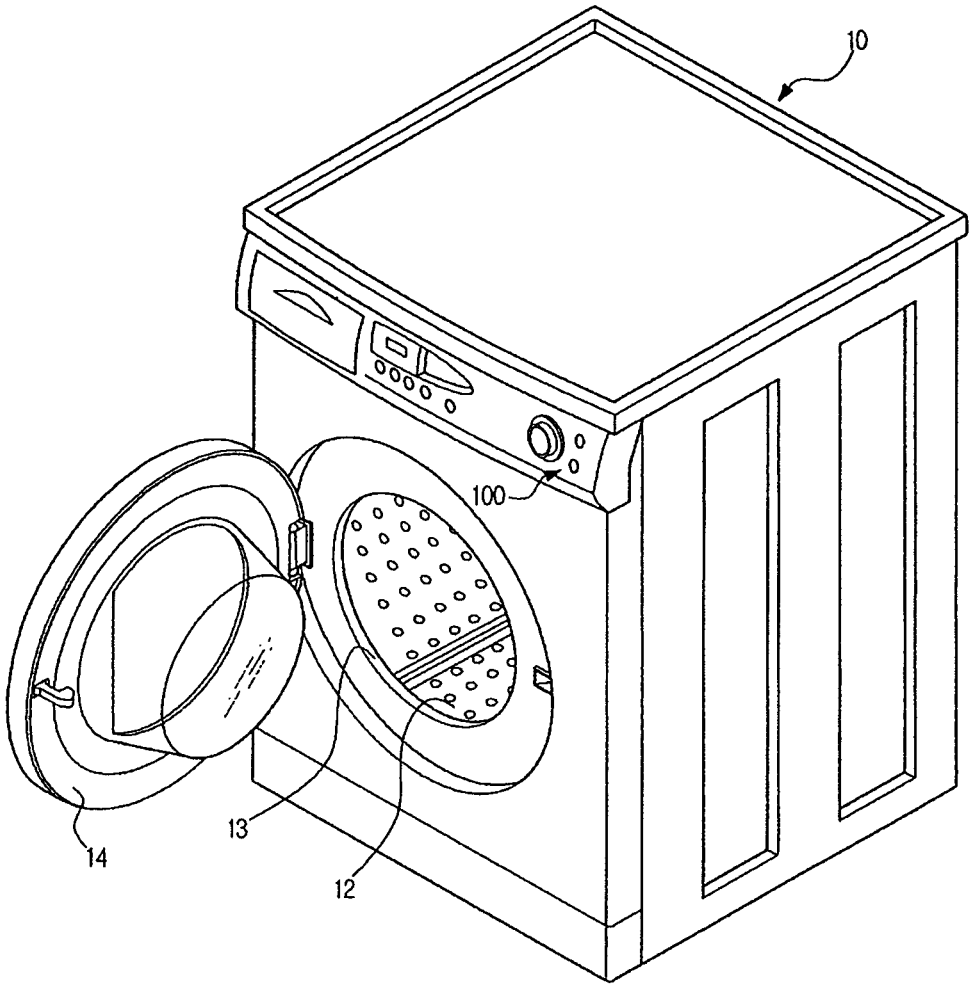
FIG. 2 is a perspective view of a washing machine in accordance with a present embodiment.

FIG. 2 is a perspective view of a washing machine in accordance with the present embodiment.

As shown in FIG. 2, the washing machine in accordance with the present embodiment includes a main body 10 forming an external appearance of the washing machine, a tub (not shown) installed in the main body 10 to store washing water, and a drum 12 rotatably installed in the tub to wash laundry. An opening 13 is formed through a front surface of the main body 10 so that a user can put laundry into an inside of the tub through the opening 13, and a door 14 to open and close the opening 13 is installed. A control panel assembly 100 to control an operation of the washing machine is provided on an upper portion of the front surface of the main body 10.

Figure 3:
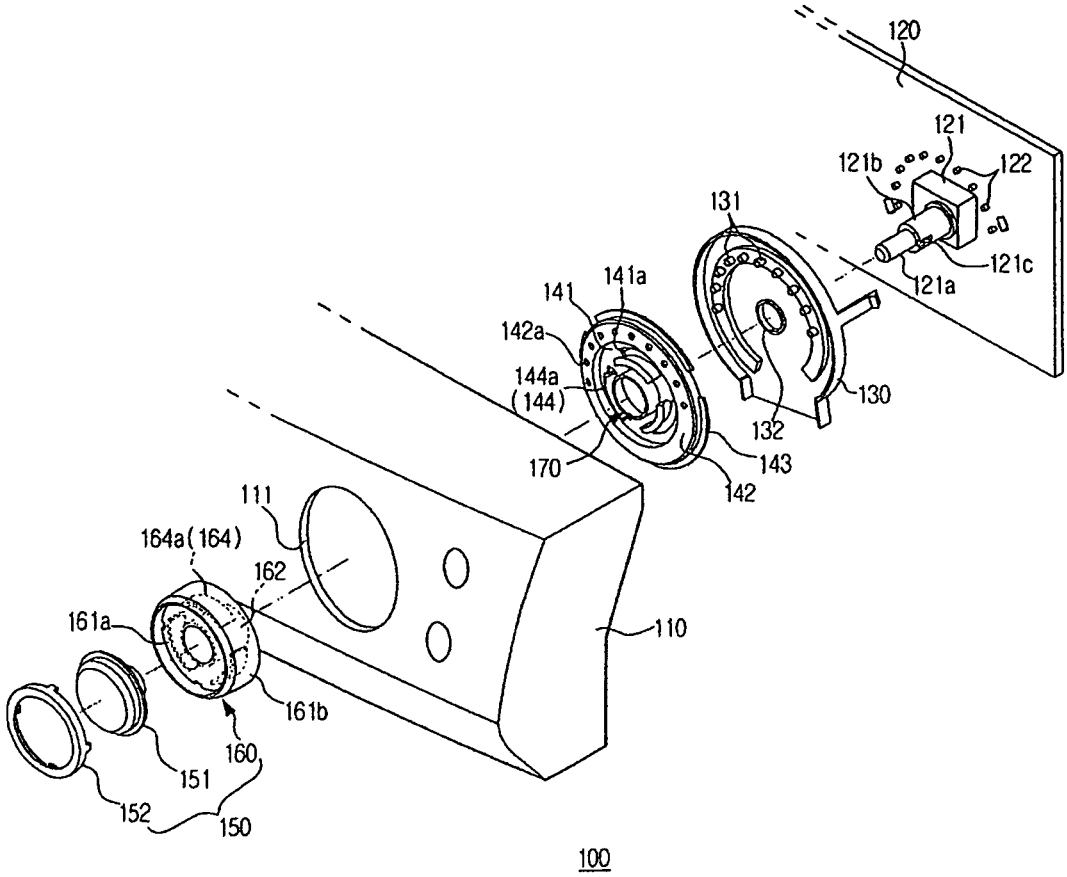
FIG. 3 is an exploded perspective view of a control panel assembly of the washing machine in accordance with the present embodiment.
Figure 4:
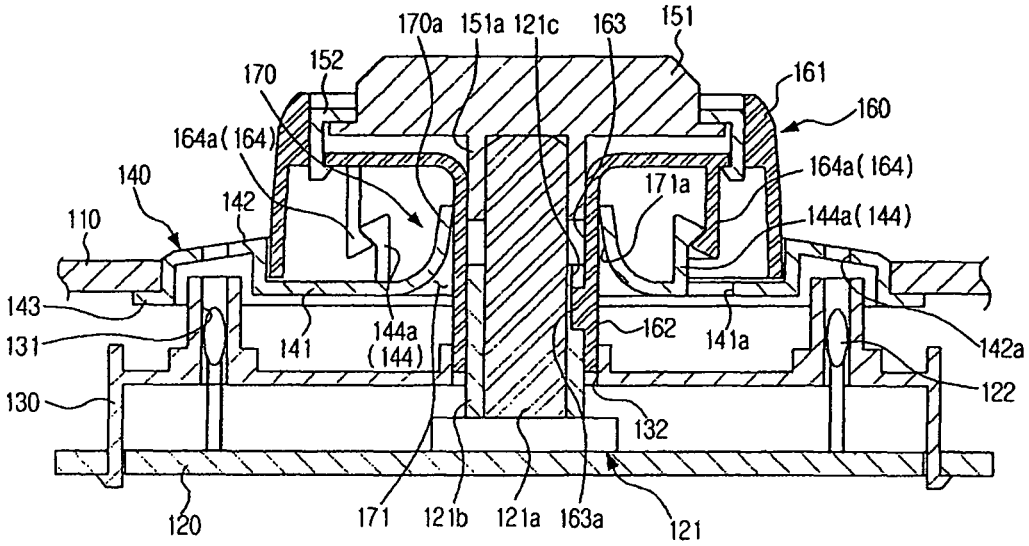
FIG. 4 is a sectional view of the control panel assembly of the washing machine in accordance with the present embodiment.

FIG. 3 is an exploded perspective view of the control panel assembly of the washing machine in accordance with the present embodiment, and FIG. 4 is a sectional view of the control panel assembly of the washing machine in accordance with the present embodiment. As shown in FIGS. 3 and 4, the control panel assembly 100 includes a control panel 110 provided with an opening 111 formed through one side thereof, and a circuit board 120 installed in the control panel 110.

A rotary switch 121 is installed on the circuit board 120, and a plurality of LEDs 122 is installed on the circuit board 120 around the rotary switch 121. The rotary switch 121 includes a push shaft 121*a* protruded forwardly, and a rotary shaft 121*b* surrounding a lower portion of the push shaft 121*a*. A knob assembly 150 including a rotary knob 160 and a push button 151 is assembled with the rotary switch 121. A user rotates the rotary shaft 121*b* of the rotary switch 121 or presses the push shaft 121*a* of the rotary switch 121 through the rotary knob 160 and the push button 151, and thus is capable of selecting a function, such as a washing course or a washing time.

An encoder bracket 130, provided with cylindrical cell parts 131 respectively covering the LEDs 122 to protect the LEDs 122 and guiding light irradiated from the LEDs 122 forwardly is installed on the circuit board 120. A through hole 132 to pass the rotary shaft 121*b* and the push shaft 121*a* of the rotary switch 121 is formed through a central portion of the encoder bracket 130.

A knob guide 140 is installed at the opening 111 of the control panel 110, and the knob assembly 150 is mounted on a front surface of the knob guide 140. The knob guide 140 serves to support the knob assembly 150 to prevent the knob assembly 150 from shaking, and to display a function, selected by rotating or pressing the knob assembly 150, to the user.

The knob guide 140 includes a base panel 141, on which the knob assembly 150 is mounted, a ring-shaped display panel 142 formed along a circumference of the base panel 141, and protrusions 143 formed along a circumference of the display panel 142. Letters or marks are printed on the display panel 142 so that the user can recognize the function selected by the knob assembly 150. The display panel 142 has light transmission parts 142*a* to transmit the light irradiated from the LEDs 122 of the circuit board 120 in a forward direction. The protrusions 143 are fastened to an edge of the opening 111 when the knob guide 140 is installed on the control panel 110. Drain holes 141*a* to drain water flowing from the outside into the base panel 141 are formed through the base panel 141.

The knob assembly 150 includes the rotary knob 160 rotatably mounted on the base panel 141 of the knob guide 140, the push button 151 disposed on the rotary knob 160, and a button cover 152 covering an edge of the push button 151.

The rotary knob 160 includes a knob body 161 having a button reception part 161*a* to receive the push button 151 formed on an upper portion thereof and a circumferential surface 161*b* to be held by a user when the operation of the washing machine is controlled, and a boss 162 protruded downwardly from a central portion of the knob body 161. A shaft insertion hole 163 is formed in the boss 162, and a connection protrusion 163*a* connected with the rotary shaft 121*b* of the rotary switch 121 is provided in the shaft insertion hole 163. The connection protrusion 163*a* is connected to a connection groove 121*c* of the rotary shaft 121*b* when the rotary shaft 121*b* of the rotary switch 121 is inserted into the shaft insertion hole 163. A button shaft 151*a* of the push button 151 is also inserted into the shaft insertion hole 163. The button shaft 151*a* inserted into the shaft insertion hole 163 is connected to the push shaft 121*a* of the rotary switch 121 in the shaft insertion hole 163. Thus, the user can operate the rotary switch 121 by rotating the rotary knob 160 or pushing the push button 151, thereby selecting a desired function.

The knob body 161 of the rotary knob 160 is seated on the base panel 141 of the knob guide 140, and the boss 162 of the rotary knob 160 passes through the base panel 141 and is extended downwardly. The knob guide 140 further includes a boss insertion part 170, which restricts the boss 162 to prevent the rotary knob 160 from shaking. Since the boss insertion part 170 prevents the rotary knob 160 from shaking, as described above, when the rotary knob 160 and the knob guide 140 contact each other, an area of friction therebetween is reduced. That is, when a conventional rotary knob rubs against surrounding parts, the circumferential surface of the body of the rotary knob rubs against the surrounding parts. However, in the present embodiment, the boss 162, which has a relatively small diameter, rubs against the boss insertion part 170, and thus noise and malfunction caused by the friction are reduced.

The boss insertion part 170 is provided with an extension 170*a* extended upwardly from the base panel 141 of the knob guide 140. A boss insertion hole 171, into which the boss 162 of the rotary knob 160 is inserted, is formed within the extension 170*a*. Although this embodiment illustrates the extension 170*a* extended upwardly, the extension 170*a* is not limited thereto and thus may be extended downwardly from the base panel 141, for example.

An inner surface of the extension 170*a*, which forms the boss insertion hole 171, is provided with an inclined surface 171*a* such that a distance between the inner surface of the extension 170*a* and the boss 162 gradually increases. That is, the extension 170*a* is provided with the inclined surface 171*a* such that a diameter of at least a part of the boss insertion hole 171 in an extended direction of the extension 170*a* is varied. The inclined surface 171*a* causes contact of the boss 162 of the rotary knob 160 with the extension 170*a* of the knob guide 140, which is similar to line contact, and thus an area of friction between the boss 162 and the extension 170*a* when the boss 162 and the extension 170*a* rub with each other is minimized.

The rotary knob 160 includes a connection part 164, which is connected to the knob guide 140, and the knob guide 140 includes a restriction part 144, which restricts the connection part 164. The connection part 164 and the restriction part 144 serve to allow the rotary knob 160 to be rotatably mounted on the knob guide 140 and to prevent the rotary knob 160 from being separated from the knob guide 140 when the user pulls the rotary knob 160.

The connection part 164, as shown in FIG. 4, may include at least one hook 164*a* (hereinafter, referred to as a 'first hook') protruded from a rear surface of the button reception part 161*a* toward the knob guide 140. Further, the restriction part 144 may include at least one hook 144*a* (hereinafter, referred to as a 'second hook') protruded from the base panel 141 toward the rotary knob 160 to be engaged with the first hook 164*a*.

Although FIG. 3 illustrates three first hooks 164*a* and three second hooks 144*a* respectively provided in the circumferential directions of the rotary knob 160 and the knob guide 140, the number of the first hooks 164*a* and the second hooks 144*a* may be properly modified as the occasion demands in terms of design.

Further, although FIG. 4 illustrates the rotary knob 160 connected to the knob guide 140 by the engagement between the first hooks 164*a* and the second hooks 144*a*, the rotary knob 160 may be connected to the knob guide 140 by hooks, which are formed on one of the rotary knob 160 and the knob guide 140, and connection holes, which are formed through the other one of the rotary knob 160 and the knob guide 140 such that the hooks are inserted into the connection holes. Here, the connection holes must have a ring shape in consideration of the rotation of the rotary knob 160.

Hereinafter, a process of assembling the control panel assembly of the washing machine in accordance with the present invention will be described with reference to FIG. 3 and FIGS. 5A to 5C.

Figure 5A:
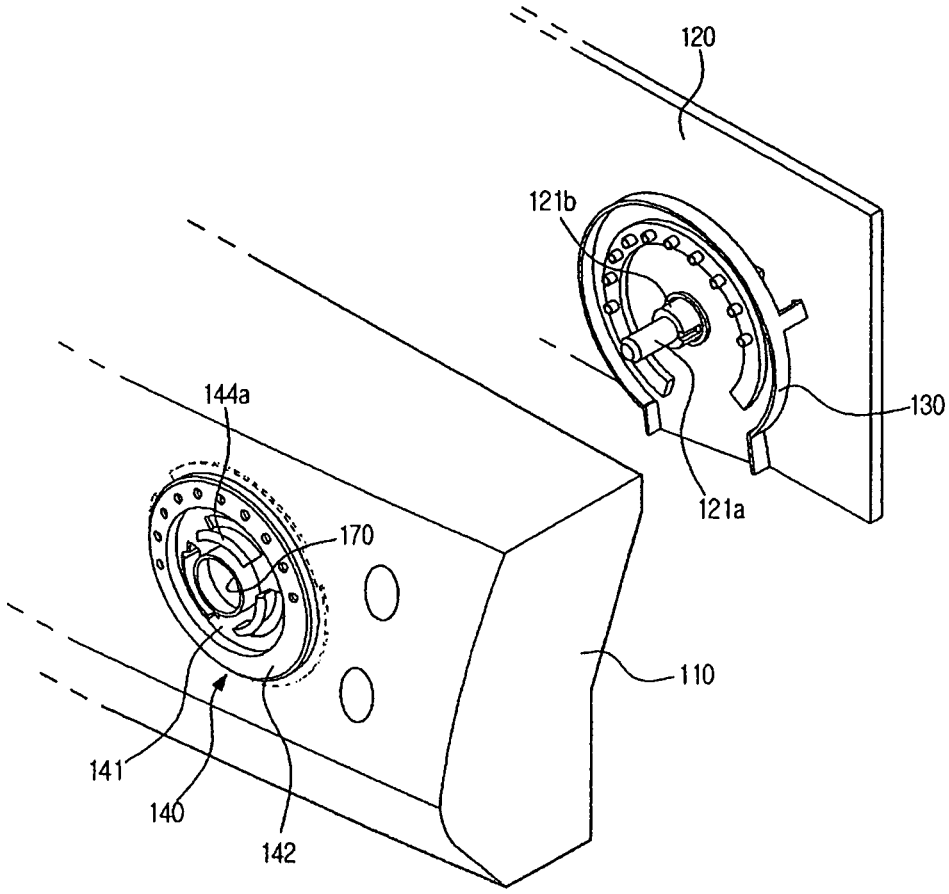
FIGS. 5A to 5C are views illustrating a process of assembling the control panel assembly of the washing machine in accordance with the present embodiment.

First, as shown in FIG. 5A, when the knob guide 140 is inserted into the opening 111 of the control panel 110 from the rear of the control panel 110, the display panel 142 and the base panel 141 are exposed from the front surface of the control panel 110 to the outside through the opening 111. The encoder bracket 130 is assembled with the circuit board 120 to protect the rotary switch 121 and the LEDs 122 installed on the circuit board 120. Here, the push shaft 121*a* and the rotary shaft 121*b* of the rotary switch 121 are protruded forward from the encoder bracket 130 through the through hole 132 of the encoder bracket 130.

Figure 5B:
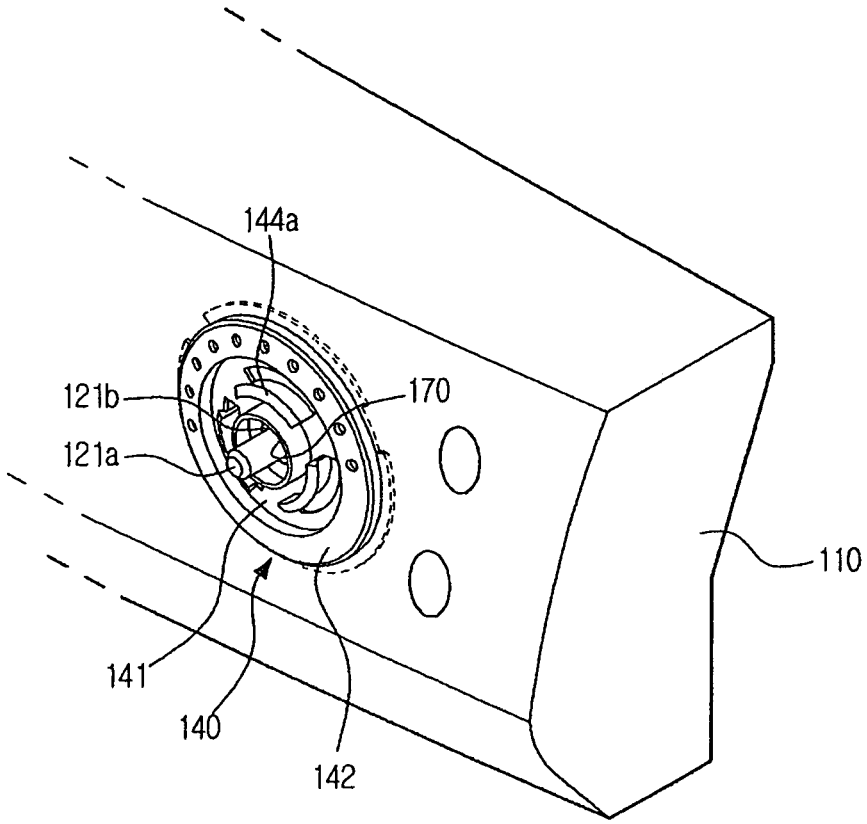

Thereafter, as shown in FIG. 5B, the circuit board 120 is fixed to the control panel 110 on which the knob guide 140 is installed by fastening members, such as screws. Then, the push shaft 121*a* and the rotary shaft 121*b* of the rotary switch 121 are exposed from the front surface of the control panel 110 to the outside through the boss insertion part 170 of the knob guide 140.

Figure 5C:
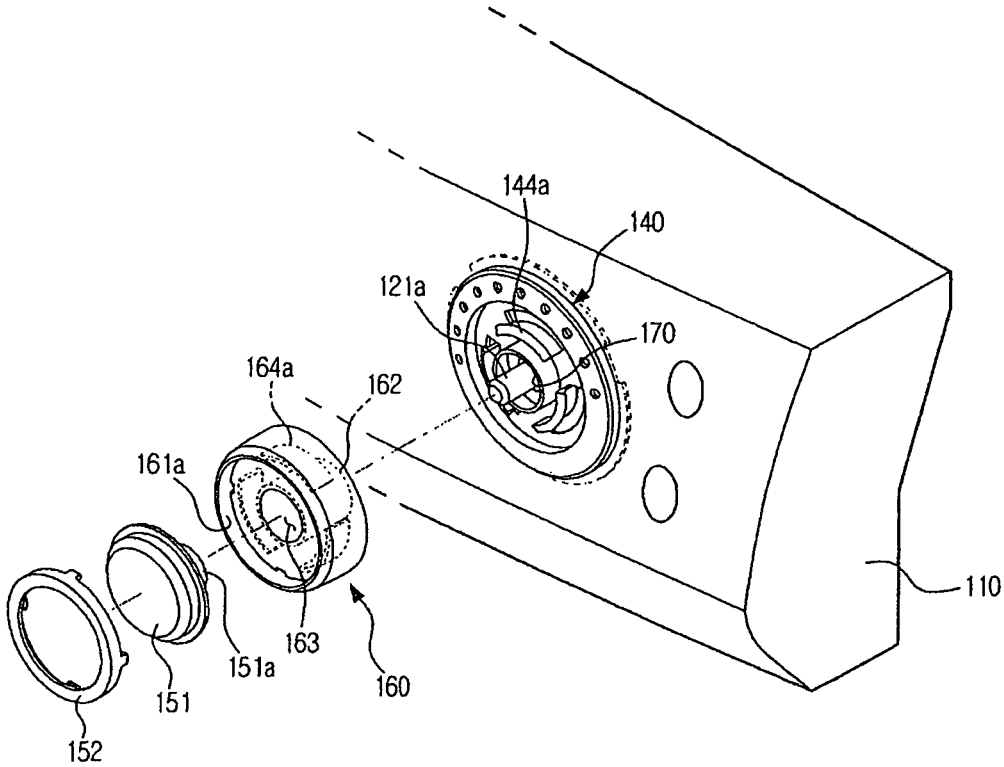

Thereafter, as shown in FIG. 5C, the rotary knob 160 is assembled with the knob guide 140 from the front of the control panel 110. Here, the boss 162 of the rotary knob 160 is inserted into the boss insertion part 170, and the first hooks 164*a* of the rotary knob 160 are engaged with the second hooks 144*a* of the knob guide 140. When the boss 162 of the rotary knob 160 is inserted into the boss insertion part 170, the rotary shaft 121*b* of the rotary switch 121 is inserted into the shaft insertion hole 163 formed in the boss 162, and thus is connected to the boss 162. Finally, the push button 151 is assembled with the button reception part 161*a* of the rotary knob 160. Here, the button shaft 151*a* of the push button 151 is connected to the push shaft 121*a* of the rotary switch 121 in the shaft insertion hole 163. When the assembling of the push button 151 with the button reception part 161*a* is completed, the button cover 152 is put on the push button 151, thus finishing the appearance of the knob assembly 150.

As apparent from the above description, the present embodiment provides a washing machine that prevents a rotary knob from shaking, and a control panel assembly thereof, thereby providing a comfortable feeling to a user manipulating the rotary knob and thus improving the reliability of a product.

Further, even when the rotary knob interferes with a surrounding knob guide, the area of friction between the rotary knob and the knob guide is minimized. Thus, noise and malfunction caused by the friction are minimized.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A washing machine having a control panel assembly to control an operation of the washing machine, the control panel assembly comprising:

a control panel;

a push button having a button shaft;

a knob guide installed on the control panel and including a boss insertion part;

a rotary knob rotatably mounted on the knob guide and including a boss passing through the knob guide; and a shaft insertion hole to receive the button shaft of the push button, wherein the boss insertion part restricts the boss to prevent the rotary knob from shaking, the boss insertion part includes an extension extended from a bottom surface of the knob guide and forming a boss insertion hole, into which the boss is inserted, therein, an inner surface of the extension forming the boss insertion hole is inclined such that a distance between the inner surface of the extension and the boss gradually increases from a point at which the extension abuts the boss, wherein the rotary knob includes first hooks protruded towards the knob guide, and the knob guide includes second hooks protruded towards the rotary knob and engaged with the first hooks.

2. The washing machine according to claim 1, wherein a diameter of the boss insertion hole is varied in an extended direction of the extension.

3. A washing machine, comprising:

a drum to receive laundry to be washed; and a control panel assembly, comprising:

a push button having a button shaft;

a rotary knob including a boss extending therefrom and a shaft insertion hole to receive the button shaft of the push button; and a knob guide receiving the boss and including an angled extension contacting the received boss to restrict the boss, wherein the angled extension abuts the boss at an abutting point and angles away from the boss from the abutting point to increase a diameter of a boss insertion hole formed between the angled extension and the boss, wherein the rotary knob includes first hooks protruded towards the knob guide, and the knob guide includes second hooks protruded towards the rotary knob and engaged with the first hooks.

4. The washing machine according to claim 3, wherein the knob guide includes a restriction part and the rotary knob includes a connection part, the restriction part and the connection part being engaged to fix the rotary knob to the knob guide when the boss is received by the knob guide.

5. The washing machine according to claim 3, wherein at least one of the knob guide and the rotary knob includes a connection part and an other of the knob guide and the rotary knob receives the connection part to affix the rotary knob and the knob guide to one another.

* * * * *